US006551169B2

(12) United States Patent
Jaffe

(10) Patent No.: US 6,551,169 B2
(45) Date of Patent: Apr. 22, 2003

(54) TOY VEHICLE WITH ROTATING FRONT END

(75) Inventor: Jonathan A. Jaffe, Voorhees, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/777,084

(22) Filed: Feb. 5, 2001

(65) Prior Publication Data

US 2001/0004578 A1 Jun. 21, 2001

Related U.S. Application Data

(63) Continuation-in-part of application No. PCT/US99/17892, filed on Aug. 6, 1999.

(51) Int. Cl.[7] ..... A63H 29/02; A63H 29/22

(52) U.S. Cl. ..... 446/462; 446/463; 446/460; 446/454; 446/456

(58) Field of Search ..... 446/462, 466, 446/469, 454, 456, 470, 468, 463, 437, 431

(56) References Cited

U.S. PATENT DOCUMENTS

| | | | | | |
|---|---|---|---|---|---|
| 1,581,688 | A | | 4/1926 | Pehrson | |
| 1,948,744 | A | | 2/1934 | Curtiss | |
| 2,026,181 | A | | 12/1935 | Kennedy | |
| 2,209,457 | A | | 7/1940 | Hare | |
| 2,216,497 | A | | 10/1940 | McHenry | |
| 2,398,541 | A | | 4/1946 | Leach | |
| 2,784,527 | A | * | 3/1957 | Sarff | 446/460 |
| 2,836,254 | A | | 5/1958 | Boehner | |
| 3,406,480 | A | * | 10/1968 | Joffe | 446/468 |
| 3,619,940 | A | | 11/1971 | Good et al. | |
| 3,813,812 | A | * | 6/1974 | Barlow et al. | 46/244 R |
| 4,055,021 | A | | 10/1977 | Okamoto | |
| 4,135,328 | A | * | 1/1979 | Yamasaki | 46/202 |
| 4,156,987 | A | * | 6/1979 | Lahr | 46/253 |
| 4,163,341 | A | | 8/1979 | Jones et al. | |
| 4,187,637 | A | | 2/1980 | Nielsen | |
| 4,218,846 | A | * | 8/1980 | Lahr | 46/262 |
| 4,248,012 | A | * | 2/1981 | Kirby et al. | 46/262 |
| 4,254,577 | A | | 3/1981 | Cheng | |

(List continued on next page.)

FOREIGN PATENT DOCUMENTS

| | | |
|---|---|---|
| DE | 879 071 | 4/1953 |
| DE | 3240712 | 5/1984 |
| EP | 0 694 323 A1 | 1/1996 |
| GB | 472946 | 10/1937 |
| GB | 967429 | 8/1964 |
| GB | 1 278 082 | 6/1972 |
| GB | 2 087 739 A | 6/1982 |
| GB | 2 130 904 A | 6/1984 |
| GB | 2 139 104 A | 11/1984 |
| GB | 2 215 626 A | 9/1989 |
| GB | 2 227 679 A | 8/1990 |

*Primary Examiner*—Derris H. Banks
*Assistant Examiner*—U. Cegielnik
(74) *Attorney, Agent, or Firm*—Akin, Gump, Strauss, Hauer & Feld, L.L.P.

(57) ABSTRACT

A radio controlled toy vehicle has a central chassis, a front end mounting a pair of front wheels which is rotatably coupled to the front of the chassis and a pair of rear wheels rotatingly mounted to the chassis. A single reversible electric motor is provided in the chassis to selectively rotate the front end with the front wheels about a generally longitudinal axis through a partial rotation for steering or through as many complete rotations as desired for stunts. The electric motor is also drivingly coupled to the rear wheels to provide propulsion power to the vehicle. A power take-off from the motor includes a one-way clutch which rotates the front end when the motor is propelling the vehicle in a reverse direction. A stop is provided to limit the free rotation of the front end. The stop releasably engages a collar around a shaft rotating the front end and is overcome by providing sufficient torque to the shaft or the front end.

20 Claims, 5 Drawing Sheets

U.S. PATENT DOCUMENTS 4,327,519 A 5/1982 Cooper et al.
4,382,599 A 5/1983 Tilbor
4,385,466 A 5/1983 Re Velle
4,415,157 A 11/1983 Lahr
4,457,101 A 7/1984 Matsushiro
4,463,520 A 8/1984 Crosman
4,522,607 A 6/1985 Kilroy et al.
4,545,776 A * 10/1985 Law ..... 446/460
4,568,306 A 2/1986 Martin
4,596,534 A 6/1986 Ishimoto
4,655,724 A 4/1987 Law
4,691,798 A 9/1987 Engelbach
4,822,316 A 4/1989 Shaffer et al.
4,846,758 A 7/1989 Chou
4,892,502 A 1/1990 Hesse
4,902,271 A 2/1990 Yoneda
5,019,009 A 5/1991 Chao-Chin et al.
5,100,368 A 3/1992 Chien
5,240,451 A 8/1993 Clark, Jr.
5,259,808 A 11/1993 Garr
5,273,480 A 12/1993 Suto
5,312,288 A 5/1994 Williams
5,334,077 A 8/1994 Bailey
5,449,311 A 9/1995 Williams
5,709,583 A 1/1998 Suto et al.
5,842,907 A 12/1998 Niimura et al.
5,882,241 A 3/1999 Mullaney et al.

* cited by examiner

TOY VEHICLE WITH ROTATING FRONT END

CROSS-REFERENCE TO RELATED APPLICATIONS

This is a continuation in part of International Application No. PCT/US99/17892 filed Aug. 6, 1999.

BACKGROUND OF THE INVENTION

The present invention relates to toy vehicles and, in particular, to powered, propelled toy vehicles having unusual transformation and action capabilities.

Toy vehicles are well known. Remotely controlled and radio controlled toy vehicles, in particular, have come to constitute a significant specialty toy market. Manufacturers constantly seek new ways and features to add innovative action to such toys to make such vehicles more versatile, more entertaining or both.

U.S. Pat. No. 5,882,241 depicts a four wheeled remotely controlled toy vehicle with rotating front end. Separate reversible motors are provided to independently rotate the front end and propel the vehicle. The front end can be rotated as many full revolutions or only a partial revolution, as desired. That patent is incorporated by reference herein in its entirety.

BRIEF SUMMARY OF THE INVENTION

The present invention is a toy vehicle comprising at least one rear wheel located on the vehicle so as to at least partially support a rear of the vehicle; a front end pivotally mounted so as to rotate around a front pivot axis extending at least generally longitudinally in a front to rear direction with respect to the vehicle; a pair of front wheels mounted on opposing lateral sides of the front end so as to rotate freely around a front wheel axis extending transversely to the front pivot axis and through the front end; and a prime mover drivingly coupled with the at least one rear wheel and further drivingly coupled with the front end so as to rotate the front end at least partially around the front pivot axis.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
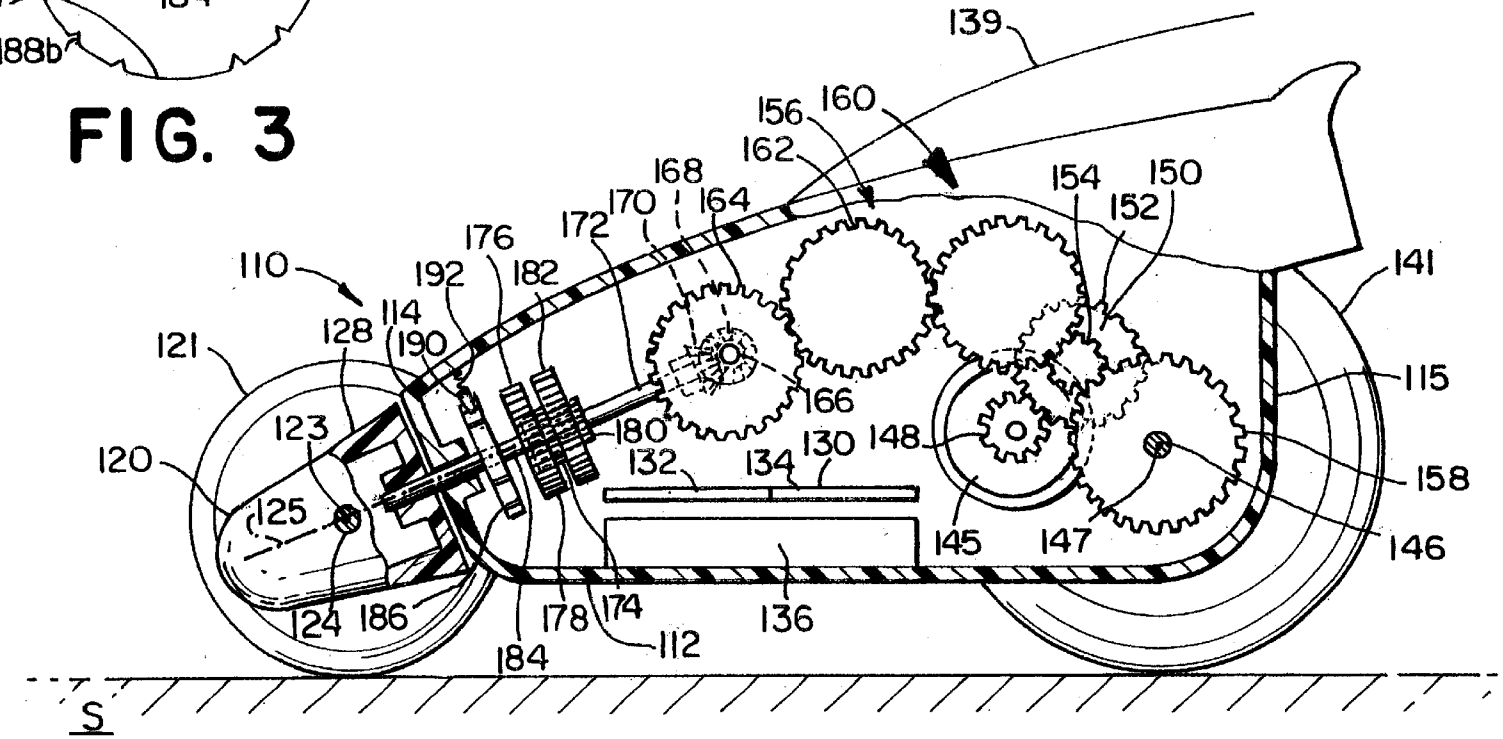
FIG. 1 is a side elevation view, in cross-section, of a preferred embodiment of a toy vehicle of the present invention.

Certain terminology is used in the following description for convenience only and is not limiting. The words "lower" and "upper" designate directions in the drawings to which reference is made. The words "inwardly" and "outwardly" refer to directions toward and away from, respectively, the geometric center of the vehicle and designated parts thereof. The word "a" is defined to mean "at least one". The terminology includes the words above specifically mentioned, derivatives thereof and words of similar import. In the drawings, like numerals are used to indicate like elements throughout.

Figure 2:
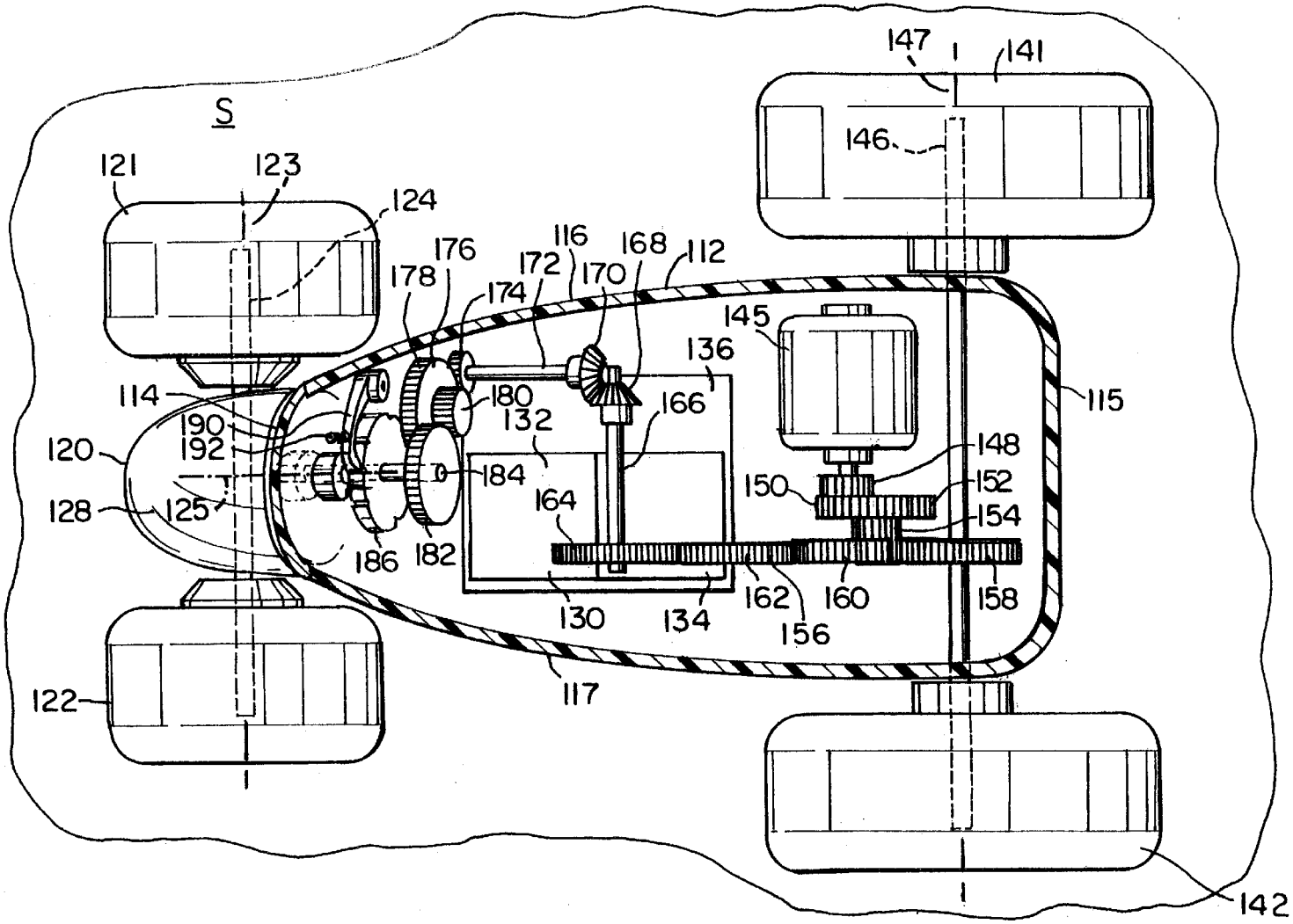
FIG. 2 is a top plan view of the drive components of the toy vehicle in FIG. 1.

There is shown in the various figures a preferred embodiment toy vehicle 110 of the present invention or its components. Referring to FIGS. 1 and 2, the toy vehicle 110 has a central longitudinal plane extending parallel to the plane of FIG. 1 and perpendicularly to the plane of FIG. 2, which divides the toy vehicle 110 in half. The vehicle 110 includes a chassis indicated generally at 112 having a front 114, a rear 115 and two opposing lateral sides 116 and 117, which also form at least parts of opposing lateral sides of the vehicle 110. The vehicle 110 further includes a separate front end indicated generally at 120. As used herein, "chassis" refers to a load-bearing structure coupled with the front end 120. The chassis 112 may be integrally formed with an outer skin or body in a monocoque construction or may be separately formed and support a non-load bearing outer skin or body. The chassis 112 and the body can be constructed of, for example, plastic or any other suitable material such as metal or composite materials. The body may be provided with vehicular detailing, which may be three dimensional (functional or non-functional) or merely surface ornamentation provided to simulate such functional elements. For example, the body may be provided with such detail as a bank of header pipes, an external fluid cooler (oil, transmission, or both), undercarriage details, etc.

The front end 120 preferably includes a pair of front wheels 121, 122, which are mounted for free rotation on opposing lateral sides of the front end 120 so as to support the front 114 of the chassis 112 and be located on opposite lateral sides 116, 117, of the vehicle 110, contacting the ground or other support surface, at least when the front end 120 is in a neutral steering position shown in FIGS. 1 and 2 with all the wheels supported on planar support surface S. The pair of front wheels 121, 122 are preferably mounted so as to rotate freely around a common front wheel axis 123 extending transversely to a front pivot axis 125 and through the front end 120. The front wheel axis 123 is preferably the central axis of a single solid front axle 124. Alternatively, separate stub axles or collars with or without a continuous front axle or stub axles (none depicted) might be provided rotatably supporting the front wheels 121, 122. Axis 123 and axle 124 extend transversely through a preferably conical body 128 of the front end 120. The front end 120 is pivotally mounted to the chassis 112 so as to rotate at least partially around the front pivot axis 125 extending at least generally longitudinally from the front 114 to the rear 115 with respect to the vehicle 110.

The vehicle 110 includes at least one and preferably a pair of ground contacting rear wheels 141, 142, which are preferably supported on a solid drive axle 146. The axle 146 has a central axis 147 fixed with respect to the rear 115 of the vehicle 110 about which the rear wheels 141, 142 rotate. Both of the rear wheels 141, 142 are preferably fixedly attached to the solid drive axle 147. The rear wheels 141, 142 are coupled with the chassis 112 and are located on opposing lateral sides 116 and 117 of the vehicle 110 so as at least partially support the rear 115 of the chassis 112 on the support surface S. Alternatively, separate collars (not depicted) may be provided on a fixed rear axle or on a pair of stub axles, with the collars drivingly engaged with the rear wheels. Front axle 124 and its axis 123 are parallel with rear axle 146 and its axis 147 when the front wheels 121, 122 are supported in the neutral steering position with the remainder of the vehicle 110 on planar support surface S.

A single prime mover 145, preferably in the form of a reversible electric motor of the type generally used in such toy vehicles, is mounted on the chassis 112 to fully power the vehicle 110. Preferably, the prime mover 145 is used to both propel the vehicle 110 and rotate its front end 120. Power from the prime mover 145 is transmitted through a drive member in the form of a pinion 148 mounted on the prime mover 145 to a gear cluster 150. The cluster 150 includes a relatively large spur gear 152 driven by the pinion 148 and a smaller spur gear 154, which is fixed to the larger gear 152 for speed reduction. The smaller spur gear 154 is drivingly engaged, preferably directly engaged with a relatively larger spur gear 158 fixedly mounted on rear axle 146 to rotate the axle 146 and the rear wheels 141, 142 when it is rotated by the gear cluster 150, pinion 148 and prime mover 145. Other drive train arrangements could be used, for example belts or other forms of power transmission and the arrangements disclosed are not meant to be limiting.

The prime mover 145 is drivingly coupled with at least one and preferably with both of the rear wheels 141, 142 in a conventional fashion through the reduction gear drive train located within the housing described above. Any of a variety of single motor drive arrangements used previously in such toy vehicles may be employed in vehicle 110 including but not limited to that of U.S. Pat. No. 5,273,480 to Suto, which is incorporated by reference herein. Typically, such arrangements include a reduction spur gear train or other reduction transmission, which drive the solid axle 146 to which both of the rear wheels 141, 142 are fixedly attached. While one prime mover 145 is required for driving both rear wheels 141, 142, a pair of propulsion prime movers could be provided. Preferably the pair of prime movers would be coupled together so as to simultaneously drive the two rear wheels 141, 142. However, less desirably, each of a pair of propulsion prime movers can be coupled separately with and independently drive a separate one of the rear wheels 141, 142.

A power take-off indicated generally at 156, drivingly coupled with the front end 120, is also driven by the prime mover 145 through a drive train to rotate the front end 120 as follows. Another relatively larger spur gear 160 is mounted as an idler and is engaged with an opposing (forward) side of the smaller spur gear 154. The spur gear 160 in turn drives another idler spur gear 162 which in turn drives a spur gear 164 fixedly mounted to a first drive shaft 166 supported for rotation within the vehicle 110. The first drive shaft 166 supports a first bevel/miter gear 168 which is engaged with a second bevel/miter gear 170 fixedly mounted to one end of a second drive shaft 172. The opposing end of the second drive shaft 172 supports a first pinion 174 engaged with the larger spur gear 176 of yet another gear cluster 178 which includes a second pinion 180 for reduction. The second pinion 180 is engaged with and drives another larger spur gear 182 fixedly mounted to one end of a third shaft 184 such that the third shaft 184 is driven by the pinion 148. The remaining end of the third shaft 184 is fixedly coupled with the rotatable front end 120 of the vehicle 10 to rotate simultaneously as one element with the front end 120. The third shaft 184 extends generally longitudinally between the front end 120 and the chassis 112. The front end 120 is pivotally supported from the chassis 112 on the third shaft 184 and defines at least part of a pivot between the front end 120 and the chassis 112. The third shaft 184 rotates the front end 120 for simultaneous rotation of the front end 120 with the third shaft 184, at least partially around the front pivot axis 125 as defined by the third shaft 184 which extends at least generally longitudinally with respect to the chassis 112 and the vehicle 110.

While spur gear sets are suggested for both the steering and the propulsion, other arrangements can be provided. For example, any suitable alternative arrangements of gears or other reduction drive including but not limited to planetary arrangements and worm gears or non-gear drives might be provided depending upon the nature of the prime mover 145 selected and the desired capability and speed of the vehicle 110. For example, where only steering capability is required or desired, a rotary action solenoid or other limited rotation prime mover may be coupled directly between the front end 120 and the chassis 112.

Figure 3:
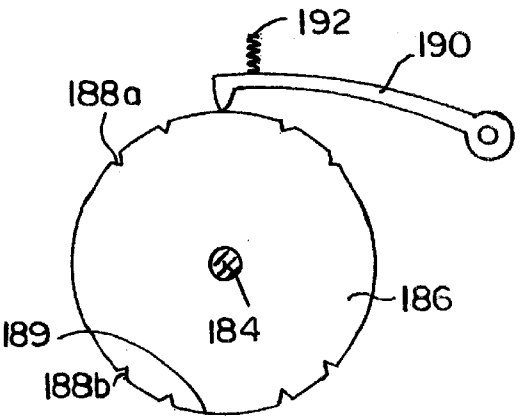
FIG. 3 is a schematic view of a detent disk for rotation of the front end.

Preferably, a detent disk 186 is also fixedly mounted around the third shaft 184. Referring to FIG. 3, the detent disk 186 is shown in greater detail and is provided with two sets of circumferential recesses or detents 188*a*, 188*b*, which can be releasably engaged by the free, distal end of a stop in the form of a pawl 190 so as to permit limited rotation of the third shaft 184 and the front end 120 about a neutral steering position before release. The distal end of the pawl 190 is biased into releasable engagement with at least one detent 188*a*, 188*b* in the disk 186 by suitable means such as a spring 192. Suggestedly, four detents in the circumferential edge of disk 186 are provided in each set of detents 188*a*, 188*b* on diametrically opposite sides of the disk 186. Pairs of the detents lie on opposite sides of a central, neutral position of the disk 186, which is indicated at 189 and which corresponds to the neutral position of the front end 120 with the front wheel axle 124 parallel with the rear wheel axle 146. The pair of detents closest to this neutral position 189 may be spaced about 45 degrees apart (i.e., about 22 to 23 degrees to either side of the neutral position) while the second, distal pair may be spaced about 90 degrees apart (i.e., about 45 degrees each from the neutral position 189).

Figure 4:
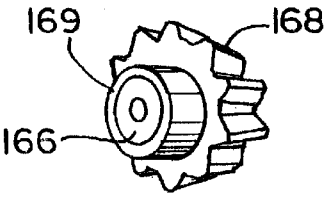
FIG. 4 is a detailed schematic view of a bevel gear incorporating a one-way clutch.

FIG. 4 illustrates schematically the provision of a one-way clutch 169 actually coupling the first bevel/miter gear 168 with the first shaft 166 and drivingly coupling the prime mover 145 to the front end 120. It may be a pawl clutch or a roller sprag clutch or any of a variety of conventional one-way clutches which would be configured to enable the prime mover 145 to transmit torque/power in only one direction through the first shaft 166 and gear 168 to rotate the front end 120. Also, the one-way clutch 169 may be located elsewhere along the power take-off between the prime mover 145 and front end 120, including, but not limited to, the second bevel/miter gear 170. Preferably, the one-way clutch 169 is located such that at least part of the drive train is located between the pinion 148 and the one-way clutch 169.

The front end 120 maybe held in an angled, non-neutral position by the detent disk 186 and pawl 190 when reverse power being supplied through the power take-off 156 to the front end 120 is stopped. The degree of rotation that the front end 120 is held at with respect to the remainder of the vehicle 110 (i.e., angle between the front and rear wheel axles 124 and 146) will depend upon various factors. Without power, the front end 120 initially will tend to rotate back to the neutral position with all four wheels parallel on a planar support surface S. However, if the pawl 190 intersects one of the detents of one of the sets 188*a*, 188*b* as the front end 120 rotates, the pawl 190 will hold the front end 120 in that angled position generally until reverse motor power is once again supplied by the prime mover 145. The prime mover/electric motor 145 generates enough torque to overcome the engagement of the pawl 190 with any of the detents so that the front end 120 will continue to rotate when power is once again supplied by the prime mover/motor 145. Also, depending upon the angle of rotation of the front end 120, the one way clutch 169 may remain engaged by the weight of the vehicle 110 when the left front (U.S. driver side) wheel is the lower one of the front wheels 121, 122 supporting the vehicle 110. The prime mover 145 propels the vehicle 110 forward in whichever direction the front wheels 121, 122 are pointing. When driven in reverse, the one-way clutch 169 draws power from the prime mover 145 to simultaneously rotate the front end 120.

The vehicle 110 is suggestedly remotely controlled, desirably wireless controlled and, preferably, radio controlled. An antenna 139 is preferably mounted to the chassis 112 and electrically coupled with circuitry 130 within the vehicle 110 in the conventional fashion. A battery power supply 136 is also electrically coupled with the circuitry 130 and preferably through the circuitry 130 with the prime mover/electric motor 145 in a conventional fashion. A hand control unit (not depicted), which would be used with the vehicle 110, could have a single toggle control providing signals for forward motion and reverse/turning motion at opposite ends of its travel or might be provided with two separate toggles, one for forward motion and one for turning motion, which would be interpreted by the vehicle as moving the vehicle 110 in reverse while rotating the front end 120 or in another suitable way for the particular configuration of the vehicle. The circuitry 130 includes a radio receiver 132 operably coupled with the prime mover 145 and a processor 134 which interprets signals from the radio receiver 132 and supplies current for the power supply 136 in the appropriate direction through the prime mover/electric motor 145. The radio receiver 132, the processor 134, the remote control device, and electric motor 145 are entirely conventional and are based on well known, existing radio controlled vehicle designs, such as disclosed in U.S. Pat. No. 5,135,427, which is incorporated by reference herein in its entirety. Such control systems can be obtained directly from manufacturers, such as Taiyo Kogyo of Tokyo, Japan and others or U.S. distributors selling radio control vehicle products and/or parts. Since the vehicle 110 of the present invention uses the same or similar controller circuitry as described in U.S. Pat. No. 5,135,427, these elements will not be further discussed herein.

Other features of the full size vehicle described in the aforesaid U.S. Pat. No. 5,882,241 may be incorporated into the vehicle 110, including but not limited to a caster mounting of the front wheels 121, 122 on the front end 120. Other types of control might be employed. Also, an uncontrolled motorized vehicle might be provided having a mechanism for flipping the direction of the motor output when the vehicle strikes another object and employ a rotating front end in the manner described above.

Although the presently preferred embodiment toy vehicle 110 is remotely controlled via radio (wireless) signals, it should be understood that other types of remotely controlled (both hard wire and other types of wireless control) vehicle toys as well as vehicle toys which are not remotely controlled are also within the scope of the invention. Thus, it is recognized that less expensive toy vehicles having some of the novel features of the invention, notably a pivoting front end, can be made and are within the scope of the invention.

If a reverse movement command is given through the hand control unit, the vehicle will back up and the front end 120 will rotate completely around front longitudinal (third) shaft 184 for as long as the command continues to be given. Spinning the front end 120 if the vehicle 110 is on its side or back will tend to cause the vehicle 110 to right itself. While it is trying to right itself, the vehicle 110 may spin around its rear wheel 141 or 142 contacting the surface S supporting the vehicle 110 on its respective side 116 or 117. The vehicle 110 can be made to do a "wheelie" stunt maneuver by driving it in reverse and then quickly changing direction to move forward.

If desired, the upper side of the chassis 112 can be provided with a wing or other raised structure (not shown), preferably along the central longitudinal plane which defines a peak, preferably over or at least near the rear wheels 141, 142, to tend to cause the vehicle 110 to roll over onto one of its sides should it flip upside down. It is then possible to right the vehicle 110 from almost any position on which it is lying on its side by spinning the front end 120.

One of ordinary skill will appreciate that, although the prime mover 145 is an electric motor, other means for moving the vehicle 110 and rotating the front end 120 could be used. Also, other prime movers, including hydraulic, pneumatic, spring wound, flywheel and other motors, even a non-reversible electric motor can be used with a remotely controlled reversing drive transmission. Also, the vehicle need not be driven in reverse. Rotation of the front end also can be accomplished by the provision of a drive train which diverts all of the reverse output of a reversible motor or other prime mover from the rear wheel(s) to rotate only the front end. Also, the drive train between the one motor or other prime mover, the rear wheel(s) and the front end could be configured to drive the rear wheel(s) in only a forward direction (one way motor) or selectively in forward or reverse directions (reversible motor) and further selectively engage a power take-off by means of a remotely controlled movable gear or the like to simultaneously rotate the front end with the rear wheel(s) regardless of the driving direction of the motor. The term "drivable coupling" when referring to the connection of the one motor or other prime mover with the front end is intended to encompass any driving engagement from the motor/prime mover to the front end, however and whenever it may occur in the operation of the vehicle.

Figure 5:
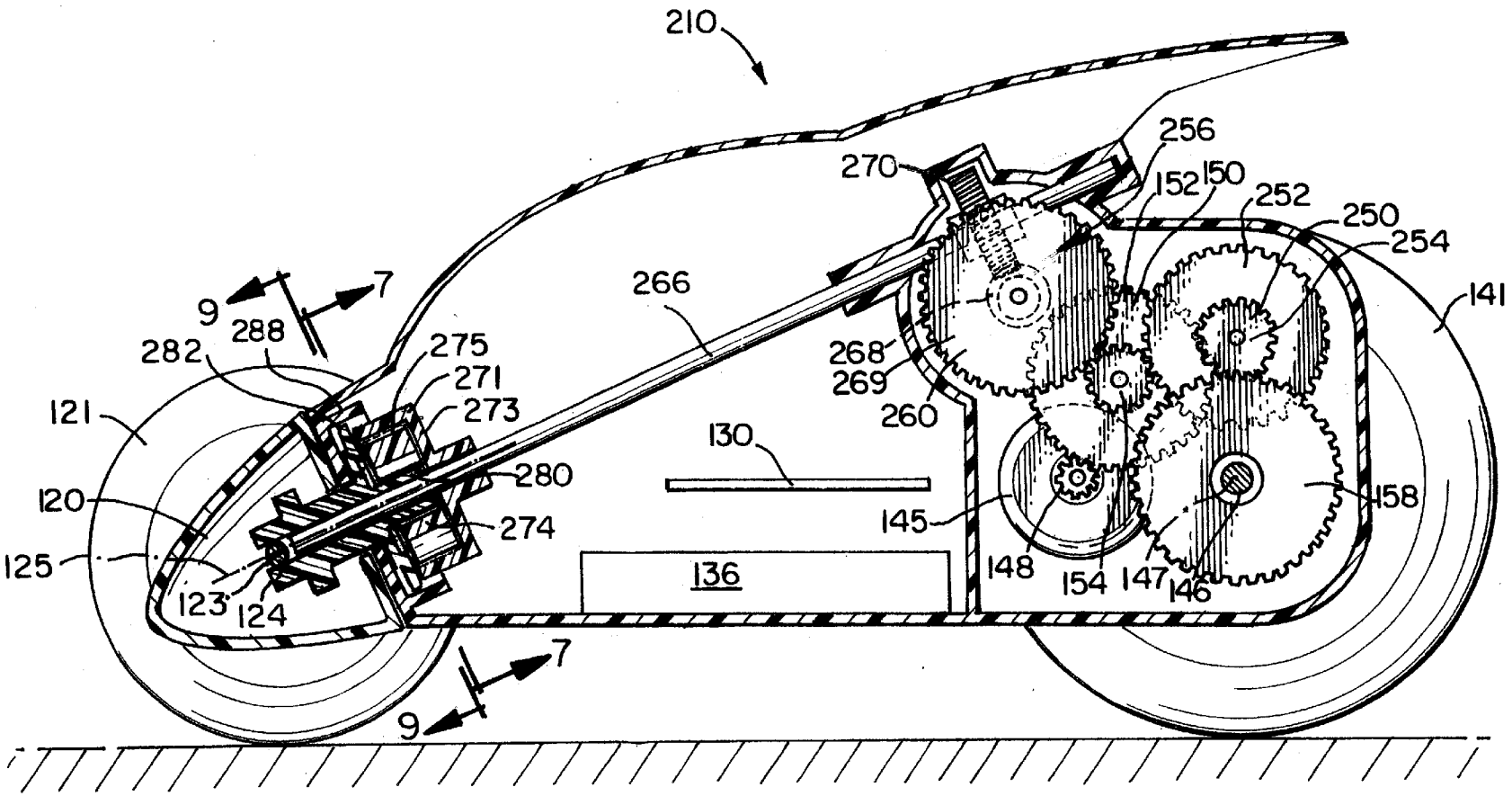
FIG. 5 is a side elevational view, in cross section, of the preferred embodiment of the toy vehicle with an alternate version of a power take-off drive.
Figure 6:
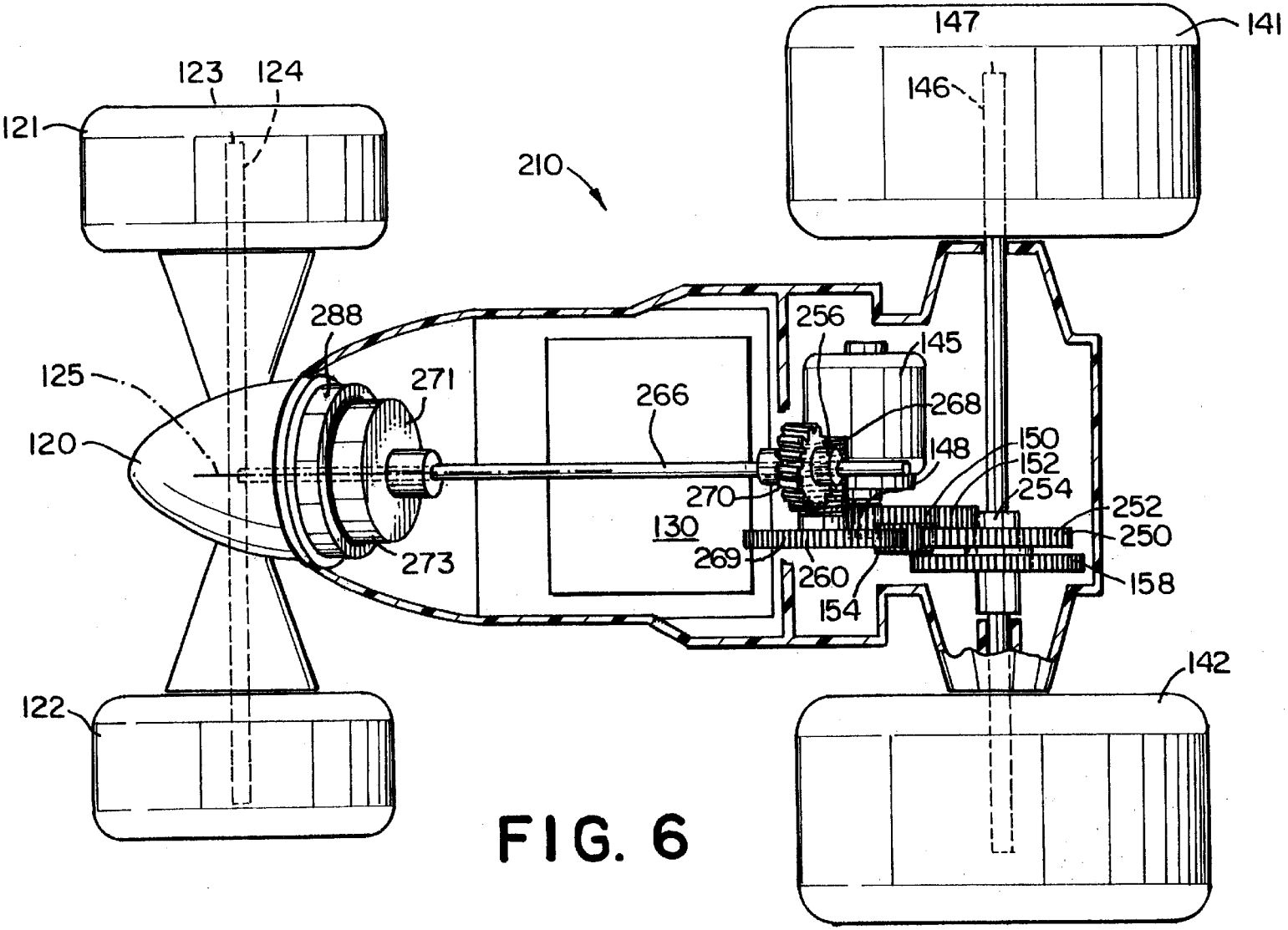
FIG. 6 is a top plan view of the drive components of the toy vehicle in FIG. 5.

An alternate version of a vehicle 210 according to the preferred embodiment is shown in FIGS. 5 and 6. A power take-off, generally indicated at 256, in the form of a worm 268 and worm gear 270, which are drivingly connected to the prime mover 145, can replace the bevel gears 168, 170 of the first version. The spur gears 160, 162, 164, 176, 182, pinions 174, 180, and the first, second and third shafts 166, 172, 184 from the first version described above can also be eliminated and replaced by a single shaft 266 and a one-way clutch, indicated generally at 271 in FIGS. 5 and 6. An additional gear cluster 250, comprised of pinion 254 and spur gear 252, is included in the drive train between gear cluster 150 and spur gear 158, with the pinion 154 of the gear cluster 150 driving the spur gear 252 and the pinion 254 driving the spur gear 158.

The worm 268 is part of a compound gear 269 that also includes a larger diameter spur gear 260 co-axial with the worm 268. Gears 152, 154, 260, worm 268, worm gear 270, and shaft 266 form a power take-off drive train between the pinion 148 and the clutch 271. The spur gear 260 meshes with and is driven by pinion 154. The shaft 266, drivingly rotatable by the worm gear 270, extends along a generally vertical central longitudinal plane through the chassis 112 in a generally front to rear direction. As seen in FIG. 5, the shaft 266 is preferably angled between 20 and 30 degrees with respect to the horizontal, and more preferably, approximately 25 degrees with respect to the horizontal, although those skilled in the art will realize that the shaft 266 can be at other angles as well. Those skilled in the art will realize that other types of power take-offs, including belts, chains or flexible rotation transmission members are possible, as are other power take-off arrangements.

A gear-incorporated clutch, like clutch 169 in the first embodiment, can be used in either the vehicle 110 or the vehicle 210, for example, incorporated into the worm gear 270 of the vehicle 210. Preferably, the alternate clutch 271, shown in FIGS. 5 and 7, can be used instead.

Figure 7:
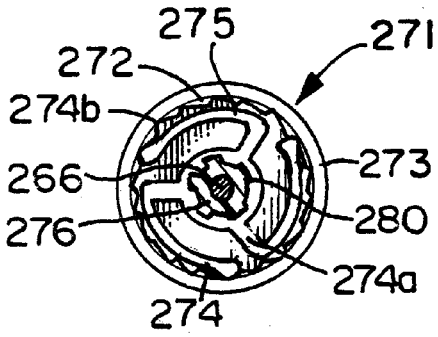
FIG. 7 is a schematic view of a one-way clutch taken along line 7—7 of FIG. 5.
Figure 8:
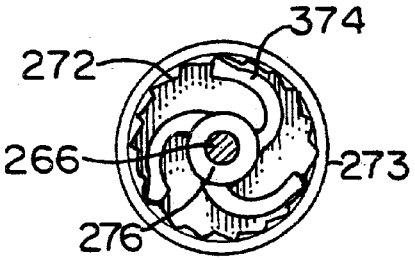
FIG. 8 is a schematic view of an alternate design of the one-way clutch.

Preferably, the clutch 271 is a ratchet-type clutch, although those skilled in the art will realize that other types of clutches can be used. The clutch 271 includes a clutch housing 273 which is fixedly connected to the shaft 266, preferably distal from the worm gear 270. As shown in FIG. 7, the clutch housing 273 includes a plurality of drive members in the form of a plurality of inwardly facing ratchet teeth 272 located on an interior perimeter of the clutch housing 273. Clutch 271 further includes a driven clutch member 275 having a plurality of ratchet arms 274, preferably three, extending from a central hub 276 which is co-axial with the shaft 266. Preferably, the ratchet arms 274 include a radially extending portion 274*a* connected to a first end of an engagement arm 274*b*. A second end of the engagement arm 274*b* engages and is driven by the ratchet teeth 272 when the clutch housing 273 (and the shaft 266) is rotated in a clockwise direction as shown in FIG. 7, which corresponds to a reverse driving direction of the rear wheels 141, 142, and the second end of the engagement arm 274*b* rides over the ratchet teeth 272 when the clutch housing 273 (and the shaft 266) is rotated in a counter-clockwise direction, corresponding to a forward driving direction of the rear wheels 141, 142. Alternatively, as shown in FIG. 8, ratchet arms 374 that are more curved can be used instead of the ratchet arms 274. The ratchet arms 274, 374 are preferably made from a resilient polymer to enable the arms 274, 374 to ratchet over the ratchet teeth 272 without breaking, although those skilled in the art will realize that other suitable materials can be used as well.

Figure 9:
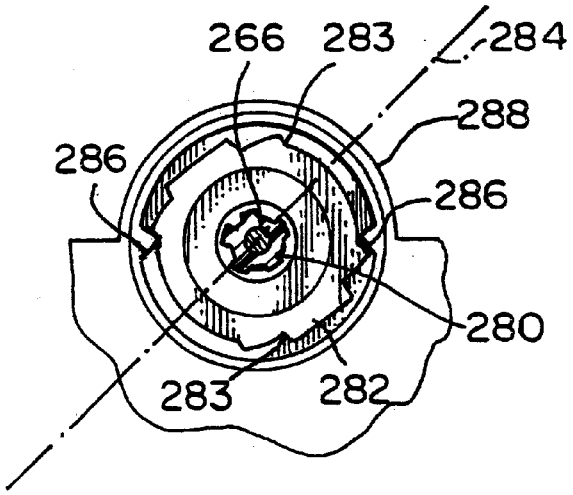
FIG. 9 is a schematic view of a first alternate design of the detent disk taken along line 9—9 of FIG. 5.
Figure 10:
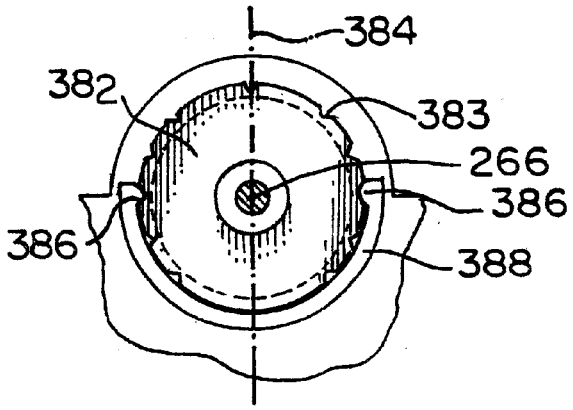
FIG. 10 is a schematic view of a second alternate design of the detent disk.

The central hub 276 of the clutch 271 is preferably keyed so as to matingly engage a splined central shaft 280 of a detent disk 282, shown in detail in FIGS. 5 and 9 so that the detent disk 282 rotates with the hub 276. However, those skilled in the art will realize that the shaft 280 need not be keyed, and the shaft can be fixed to the detent disk by an adhesive or a swaged fitting, as shown in FIG. 10. The shaft 280 of the detent disk 282 extends longitudinally between the front end 120 and a remainder of the vehicle 210 in a generally front to rear direction, and is drivingly connected to the front end 120 to define at least part of a pivot between the front end 120 and the remainder of the vehicle 210 for pivoting the first end 120 about the axis of the drive shaft 266.

The disk 282 includes a plurality of spaced detents or detents 283 located on the outer perimeter of the disk 282 at locations (i.e., approximately 45°, 60°, 120°, and 135°) on either side of a central axis 284. The detents 283 engage detent pins 286 which are longitudinally spaced apart from each other along an inner perimeter of a detent housing 288 provided on the inner side of a front wall of the chassis 112. As shown in FIG. 5, the forward most end of the shaft 280 through the detent disk 282 is shaped into a yoke which receives the front axle 124 and is thus fixedly coupled with the front axle 124 for rotation together. The detent disk 282 rotates the front axle 124 about the front pivot axis 125 (which is the central axis of shaft 280) when the shaft 266 rotates in the clockwise direction as shown in FIG. 7.

The detents 283 and the detent pins 286 are sized to require a considerable amount of driving force from the prime mover 145, or other force, such as from a collision with another object or dropping the vehicle 210 to the ground from a significant height, to rotate the detent disk 282 past the detent pins 286.

An alternative detent design is shown in FIG. 10, in which a detent housing 388 extends only partially around the outer perimeter of a detent disk 382, with inwardly facing detent pins 386 on each end of the detent housing 388. The disk 382 includes a plurality of spaced detents 383 located on the outer perimeter of the disk 382 at locations (i.e., approximately 45°, 67½°, 90°, 112½°, and 135°) on either side of a central axis 384. The detents 383 engage the detent pins 386 in the same manner as the detents 283 and the detent pins 286 described above. However, the fact that the housing 388 is not a closed loop allows the housing 388 to spring outwardly, requiring less force to rotate the detent disk 382 than the force required to rotate the detent disk 282 described above. Those skilled in the art will realize that other detent and detent disk designs can be used as well without departing from the spirit and scope of the present invention.

Although the invention is described herein in terms of the preferred, fourwheeled embodiment, the present invention could also comprise a vehicle having three wheels, or more than four wheels.

The operation of the vehicle 210 is the same as the operation of the vehicle 110 as described above, with the worm 268 and the worm gear 270 being drivingly coupled to the front end 120 so as to rotate the front end 120 at least partially around the front pivot axis 125.

It will be appreciated by those skilled in the art that changes could be made to the embodiment described above without departing from the broad inventive concept thereof. It is understood, therefore, that this invention is not limited to the particular versions of the embodiment disclosed, but it is intended to cover modifications within the spirit and scope of the present invention as defined by the appended claims.

What is claimed is:

1. A toy vehicle comprising:

at least one rear wheel located on the vehicle so as to at least partially support a rear end of the vehicle; a front end pivotally mounted so as to rotate around a front pivot axis extending at least generally longitudinally in a front to rear direction with respect to the vehicle;

a pair of front wheels mounted on opposing lateral sides of the front end so as to rotate freely around a front wheel axis extending transversely to the front pivot axis and through the front end; and a prime mover drivingly coupled with the at least one rear wheel and further being drivingly coupled with the front end so as to rotate the front end at least partially around the front pivot axis.

2. The toy vehicle of claim 1 further comprising:

a shaft extending longitudinally between the front end and a remainder of the vehicle and defining at least part of a pivot between the front end and the remainder of the vehicle;

a drive member mounted on the prime mover; and a driven member drivingly coupled with the drive member and fixedly coupled with the front end.

3. The toy vehicle of claim 2 wherein the drive member (148) is a pinion and wherein the driven member is mounted on the shaft.

4. The toy vehicle of claim 3 wherein the shaft is fixedly secured with the front end for simultaneous rotation of the front end with the shaft.

5. The toy vehicle of claim 3 further comprising a stoppositioned for releasable engagement with the shaft so as to permit limited rotation of the shaft before release.

6. The toy vehicle of claim 3 further comprising a stop biased into releasable interference engagement with at least one recess in a detent disk around the shaft.

7. The toy vehicle of claim 2 further comprising a power take-off between the pinion and the driven member.

8. The toy vehicle of claim 3 wherein the power take-off includes a one-way clutch.

9. The toy vehicle of claim 1 further comprising a detent positioned so as to limit rotation of the front end on the front pivot axis about a neutral steering position.

10. The toy vehicle of claim 1 further comprising a one-way clutch drivingly coupling the prime mover to the front end, the one-way clutch being configured to enable the prime mover to rotate the front end in only one direction about the front pivot axis.

11. The toy vehicle according to claim 1 being configured for remote control.

12. The toy vehicle of claim 1 further comprising a radio receiver operably coupled with the prime mover.

13. The toy vehicle according to claim 1 wherein the at least one rear wheel rotates about an axis fixed with respect to the rear of the vehicle.

14. The toy vehicle of claim 1 further comprising:

a chassis having a front, a rear and opposing lateral sides, the opposing lateral sides also being on opposing lateral sides of the vehicle;

the at least one rear wheel being coupled with the chassis and located on the vehicle so as to at least partially support the rear of the chassis;

the front end being pivotally coupled with the chassis so as to rotate at least partially around the front pivot axis; and the prime mover being mounted on the chassis.

15. The toy vehicle of claim 14 further comprising:

a shaft extending longitudinally between the front end and the chassis and defining at least part of a pivot between the front end and the chassis;

a drive member mounted on the prime mover; and a driven member drivingly coupled with the drive member and fixedly coupled with the front end.

16. The toy vehicle of claim 15 wherein the driven member is part of a one-way clutch.

17. The toy vehicle of claim 16 further comprising a radio receiver operably coupled with the prime mover.

18. The toy vehicle of claim 17 wherein the prime mover is a reversible electric motor.

19. The toy vehicle of claim 15 wherein the drive member is a pinion and wherein the driven member is fixedly mounted on the shaft and wherein the shaft is fixedly secured with the front end for simultaneous rotation of the front end with the shaft.

20. The toy vehicle of claim 15 wherein the driven member is mounted to rotate with respect to the shaft.

* * * * *